US009533802B2

(12) United States Patent
Berge

(10) Patent No.: US 9,533,802 B2
(45) Date of Patent: Jan. 3, 2017

(54) CLOSURE WITH TAMPER BAND AND SPOUT

(71) Applicant: Silgan White Cap LLC, Downers Grove, IL (US)

(72) Inventor: Gary Berge, Crystal Lake, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 14/661,740

(22) Filed: Mar. 18, 2015

(65) Prior Publication Data

US 2016/0122095 A1 May 5, 2016

Related U.S. Application Data

(60) Provisional application No. 62/073,745, filed on Oct. 31, 2014.

(51) Int. Cl.

| | |
|---|---|
| ***B65D 41/34*** | (2006.01) |
| ***B65D 47/12*** | (2006.01) |
| ***B65D 75/00*** | (2006.01) |

(52) U.S. Cl.

CPC ..... *B65D 47/12* (2013.01); *B65D 47/122* (2013.01); *B65D 75/008* (2013.01); *B65D 2101/003* (2013.01); *B65D 2101/0046* (2013.01)

(58) Field of Classification Search

CPC ..... B65D 2101/0046; B65D 41/34; B65D 41/3409; B65D 47/12; B65D 47/122; B65D 75/5877; B65D 2101/003; B65D 75/008

See application file for complete search history.

(56) References Cited

U.S. PATENT DOCUMENTS

| | | | |
|---|---|---|---|
| 2,148,864 | A | 2/1939 | Kistner |
| 3,463,341 | A | 8/1969 | Fileds |
| 4,305,516 | A | 12/1981 | Perne |

(Continued)

FOREIGN PATENT DOCUMENTS

| | | | |
|---|---|---|---|
| DE | 296 09 596 | U1 | 10/1996 |
| JP | 10-181758 | A | 7/1998 |

(Continued)

OTHER PUBLICATIONS

International Search Report and Written Opinion for PCT/US2015/056238, mailed Dec. 30, 2015, 11 pages.

(Continued)

*Primary Examiner* — Frederick C Nicolas
*Assistant Examiner* — Bob Zadeh
(74) *Attorney, Agent, or Firm* — Reinhart Boerner Van Deuren s.c.

(57) ABSTRACT

A tamper evident closure and spout are provided. The closure includes an outer wall and a central wall supported from the outer wall. The closure defines a passage extending between an upper edge and a lower edge of the closure and located between an inner surface of the outer wall and an outer surface of the central wall. The closure includes a tamper-indicating band extending from the central wall. The spout includes a wall portion and a central channel extending through the wall portion between an inlet opening and an outlet opening. The spout includes a structure located below the inlet opening the first and second exterior surfaces are both angled toward the central axis of the spout.

20 Claims, 13 Drawing Sheets

(56) References Cited

U.S. PATENT DOCUMENTS

| | | | |
|---|---|---|---|
| D272,324 | S | 1/1984 | Mumford et al. |
| D273,368 | S | 4/1984 | Hayes |
| 4,503,986 | A | 3/1985 | Nixdorff et al. |
| 4,505,401 | A | 3/1985 | Berglund |
| D278,311 | S | 4/1985 | Brown et al. |
| 4,573,601 | A | 3/1986 | Berglund |
| 4,653,657 | A | 3/1987 | Papavasilopoulos |
| 4,805,791 | A | 2/1989 | Begley |
| 4,852,751 | A | 8/1989 | Halfacre |
| 5,040,692 | A | 8/1991 | Julian |
| 5,295,600 | A | 3/1994 | Kowal |
| D359,683 | S | 6/1995 | Beach et al. |
| D361,265 | S | 8/1995 | Doxey |
| 5,823,383 | A | 10/1998 | Hins |
| 5,853,095 | A | 12/1998 | Marshall et al. |
| 5,927,549 | A | 7/1999 | Wood |
| D445,678 | S | 7/2001 | Malmborg |
| 6,330,959 | B1 | 12/2001 | Dark |
| D454,066 | S | 3/2002 | Trabal |
| D460,357 | S | 7/2002 | Kras et al. |
| D467,501 | S | 12/2002 | Tacchella |
| 6,557,714 | B2 | 5/2003 | Babcock et al. |
| D476,565 | S | 7/2003 | Rosén |
| 6,612,466 | B1 | 9/2003 | Malin |
| D489,978 | S | 5/2004 | Brown |
| 6,783,014 | B2 | 8/2004 | Luker |
| 6,811,047 | B1 | 11/2004 | Hicks et al. |
| 6,860,406 | B2 | 3/2005 | Kobetsky et al. |
| 6,958,033 | B1 | 10/2005 | Malin |
| D542,654 | S | 5/2007 | Szczesniak |
| D542,655 | S | 5/2007 | Szczesniak |
| D542,656 | S | 5/2007 | Szczesniak |
| D544,348 | S | 6/2007 | Szczesniak |
| D547,657 | S | 7/2007 | Tacchella |
| D551,975 | S | 10/2007 | Gomoll et al. |
| D552,483 | S | 10/2007 | Rigardo |
| D564,884 | S | 3/2008 | Rittman |
| D574,241 | S | 8/2008 | Braukmann et al. |
| D579,332 | S | 10/2008 | Krivoshein |
| 7,677,422 | B2 | 3/2010 | Lee |
| 7,735,666 | B2 | 6/2010 | Niwa et al. |
| 7,753,233 | B2 | 7/2010 | Umenaka |
| D631,349 | S | 1/2011 | Arnell et al. |
| 7,882,977 | B2 | 2/2011 | Johnson |
| D633,386 | S | 3/2011 | Taber et al. |
| D634,199 | S | 3/2011 | Taber et al. |
| D634,200 | S | 3/2011 | Taber et al. |
| D646,263 | S | 10/2011 | Yuan et al. |
| 8,105,226 | B2 | 1/2012 | Wada |
| D661,185 | S | 6/2012 | Battat |
| 8,231,020 | B2 | 7/2012 | Taber et al. |
| 8,231,025 | B2 | 7/2012 | Johnson |
| D671,187 | S | 11/2012 | Saringer |
| D672,238 | S | 12/2012 | Aziz et al. |
| D672,241 | S | 12/2012 | Sawicki et al. |
| D679,597 | S | 4/2013 | Tamarindo |
| D682,688 | S | 5/2013 | Murray |
| 8,443,999 | B1 | 5/2013 | Reinders |
| D684,055 | S | 6/2013 | Kwon |
| D684,056 | S | 6/2013 | Kwon |
| D684,057 | S | 6/2013 | Kwon |
| D684,058 | S | 6/2013 | Kwon |
| D686,495 | S | 7/2013 | Murray |
| 8,528,757 | B2 | 9/2013 | Bisio |
| D693,220 | S | 11/2013 | Luo |
| 8,616,394 | B2 | 12/2013 | Kim |
| D705,061 | S | 5/2014 | Jo et al. |
| D710,772 | S | 8/2014 | Maiorana et al. |
| 8,807,361 | B2 | 8/2014 | Luo |
| D712,266 | S | 9/2014 | Römer et al. |
| D712,743 | S | 9/2014 | Neputy et al. |
| D712,744 | S | 9/2014 | Neputy et al. |
| 8,950,939 | B2 | 2/2015 | Last et al. |
| 2004/0200797 | A1 | 10/2004 | Hicks et al. |
| 2004/0245286 | A1 | 12/2004 | Lee |
| 2005/0011911 | A1 | 1/2005 | Vaughan |
| 2005/0040181 | A1 | 2/2005 | Kurosawa et al. |
| 2005/0139607 | A1 | 6/2005 | Kobetsky et al. |
| 2005/0205438 | A1 | 9/2005 | Hierzer et al. |
| 2008/0124432 | A1 | 5/2008 | Ma |
| 2008/0135513 | A1 | 6/2008 | Umenaka |
| 2009/0223963 | A1* | 9/2009 | Bisio ..... B65D 41/3404 220/304 |
| 2010/0213213 | A1 | 8/2010 | Albers et al. |
| 2011/0210122 | A1 | 9/2011 | Benoit-Gonin et al. |
| 2012/0211460 | A1 | 8/2012 | Tamarindo |
| 2012/0325769 | A1 | 12/2012 | Essebaggers et al. |
| 2013/0270270 | A1* | 10/2013 | Reinders ..... B65D 41/34 220/276 |
| 2014/0010481 | A1* | 1/2014 | Last ..... B65D 75/5883 383/5 |
| 2014/0048536 | A1 | 2/2014 | Bisio |
| 2014/0263475 | A1 | 9/2014 | Totten |
| 2015/0129533 | A1 | 5/2015 | Taber et al. |
| 2015/0232237 | A1 | 8/2015 | Berge |

FOREIGN PATENT DOCUMENTS

| | | |
|---|---|---|
| JP | 10-258850 | 9/1998 |
| JP | 2002-104447 A | 4/2002 |
| JP | 2011-246128 A | 12/2011 |
| JP | 2014-019447 | 2/2014 |
| KR | 2002-0024043 | 3/2002 |
| WO | WO 2004/045977 A1 | 6/2004 |
| WO | WO 2008/050361 A1 | 5/2008 |

OTHER PUBLICATIONS

U.S. Appl. No. 29/482,293, filed Feb. 17, 2014, Gary Berge et al.
Images of Spouts and Closures, document believed to be publicly available at least by Aug. 2012, 1 page.
Gualapack System, Image of Spouts and Caps, dated Apr. 1, 2013, at http://www.gualapack.com/img/pagine/prodotti/tappi/1.jpg, believed to be publicly available from Gualapack System at least by Aug. 2012, 1 page.
Gualapack System, Image of first stacked caps, dated Apr. 1, 2013, at http://www.gualapack.com/img/pagine/prodotti/innovazione/1.jpg, believed to be publicly available from Gualapack System at least by Aug. 2012, 1 page.
Gualapack System, Image of second stack caps, dated Apr. 1, 2013, at http://www.gualapack.com/img/pagine/prodotti/innovazione/2.jpg, believed to be publicly available from Gualapack System at least by Aug. 2012, 1 page.
Gualapack System, Image of third stacked caps, dated Apr. 1, 2013, at http://www.gualapack.com/img/pagine/prodotti/innovazione/3.jpg, believed to be publicly available from Gualapack System at least by Aug. 2012, 1 page.
Flexible Packaging. Silgan White Cap to Introduce Secure-Spout Pouch Technology at Global Pouch Forum. Jun. 1, 2014 [online], [site visited Nov. 18, 2015]. Available from Internet, <URL:http://www.flexpackmag.com/keywords/4416-silgan-white-cap>.
Silgan White Cap, Secure-Spout—9mm Spout with Fitment Brochure, believed to be publically available on Jun. 11, 2014 2014 and representative of closure and spout believed to be publically available on Jun. 11, 2014, 3 pages.
U.S. Appl. No. 14/182,130, filed Feb. 17, 2014, Berge et al.
U.S. Appl. No. 14/077,868, filed Nov. 12, 2013, Taber et al.
U.S. Appl. No. 29/472,406, filed Nov. 12, 2013, Taber et al.
U.S. Appl. No. 29/449,192, filed Mar. 14, 2013, Neputy et al.
U.S. Appl. No. 29/507,935, filed Oct. 31, 2014, Berge et al.

* cited by examiner

CLOSURE WITH TAMPER BAND AND SPOUT

CROSS-REFERENCE TO RELATED PATENT APPLICATION

This application claims priority to and the benefit of U.S. Provisional Patent Application No. 62/073,745, filed Oct. 31, 2014, which is incorporated herein by reference in its entirety.

BACKGROUND OF THE INVENTION

The present invention relates to a cap and spout assembly for closing a container such as a pouch which holds a material having a liquid or gel-like consistency. In particular, the present invention relates to a child-safe closure with an integral, molded and folded tamper band and to a related spout design. In particular embodiments, the spout includes features for improving visibility of the tamper band and/or for limiting the ability of a flexible container, such as a pouch, to occlude the input opening of the spout.

SUMMARY OF THE INVENTION

One embodiment of the invention relates to a container closure assembly including any combination of one or more feature described herein. Another embodiment of the invention relates to a closure including any combination of one or more feature described herein. Another embodiment of the invention relates to a spout including any combination of one or more feature described herein. Another embodiment of the invention relates to a container including any combination of one or more feature described herein.

Another embodiment of the invention relates to a closure that includes an outer wall with a central opening and central wall portion having an engagement structure configured to engage a cooperating structure on a spout. The closure includes a passage extending between upper and lower surfaces of the closure and located between the outer wall and the central wall portion. The closure includes a tamper band extending from a lower portion of the central wall portion, and the tamper band includes at least one integrally molded portion extending radially inward and upward away from a lower portion of the tamper band.

Another embodiment of the invention relates to a spout that includes a threaded cylindrical wall portion defining a channel extending between an input opening and an output opening. The spout includes a structure extending below the input opening. The structure defines a generally horizontal channel extending between first and second opposing surfaces, and the first and second opposing surfaces extend downward and are both angled toward a central axis of the spout.

Another embodiment of the invention relates to a tamper evident closure that includes an outer wall having an inner surface and an outer surface. The closure includes a central wall supported from the outer wall, and the central wall has an inner surface, an outer surface and an engagement structure located on the inner surface and configured to engage cooperating structures on a spout. The closure includes a passage extending between an upper edge and a lower edge of the closure, and the passage is defined between the inner surface of the outer wall and the outer surface of the central wall. The closure includes a tamper-indicating band extending from the central wall. The tamper band includes a first outer wall portion extending downwardly from the central wall and a first inner engagement wall extending radially inward and upward away from the first outer wall portion. The first inner engagement wall includes an outer surface facing an inner surface of the first outer wall portion and an inner surface facing radially inward toward the central wall. The tamper band includes a first connector having a first end coupled to the first outer wall portion and a second end coupled to the first inner engagement wall.

Another embodiment of the invention relates to a spout for a container configured to be sealed by a closure. The spout includes a wall portion. The wall portion includes an engagement structure extending from an outer surface of the wall portion configured to engage with a cooperating engagement structure of the closure. The spout includes a central channel extending through the wall portion between an inlet opening and an outlet opening, and the channel surrounds a central axis of the spout. The spout includes a structure located below the inlet opening. The structure includes a first exterior surface on a first side of the structure, and the first exterior surface extends away from the inlet opening. The structure includes a second exterior surface on a second side of the structure opposite the first side, and the second exterior surface extends away from the inlet opening. The structure includes a lower channel extending between the first and second exterior surfaces and located below the inlet opening. The first and second exterior surfaces are both angled toward the central axis of the spout such that a width between opposing portions of the first and second exterior surfaces at a lower end of the structure is less than a width between opposing portions of the first and second exterior surfaces at an upper end of the structure.

Another embodiment of the invention relates to a closure assembly. The closure assembly includes a spout and a closure. The spout includes a wall portion including an engagement structure extending from an outer surface of the wall portion and a central channel extending through the wall portion between an inlet opening and an outlet opening. The channel surrounds a central axis of the spout. The spout includes a structure located below the inlet opening. The structure includes a first exterior surface on a first side of the structure, and the first exterior surface extends away from the inlet opening. The structure includes a second exterior surface on a second side of the structure opposite the first side, and the second exterior surface extends away from the inlet opening. The structure includes a lower channel extending between the first and second exterior surfaces and located below the inlet opening. The first and second exterior surfaces are both angled toward the central axis of the spout such that a width between opposing portions of the first and second exterior surfaces at a lower end of the structure is less than a width between opposing portions of the first and second exterior surfaces at an upper end of the structure. The closure includes an outer wall having an inner surface and an outer surface and a central wall supported from the inner surface of the outer wall. The central wall includes an inner surface, an outer surface and an engagement structure located on the inner surface and configured to engage the engagement structure of the spout. The closure includes a passage extending between an upper edge and a lower edge of the closure, and the passage is defined between the inner surface of the outer wall and the outer surface of the central wall. The closure includes a tamper-indicating band extending from the central wall. The tamper band includes a first outer wall portion extending downwardly from the central wall, and a first inner engagement wall extending radially inward and upward away from the first outer wall portion. The first inner engagement wall includes an outer surface facing an inner surface of the first outer wall portion and an inner surface facing radially inward toward the central wall. The tamper band includes a first connector having a first end coupled to the first outer wall portion and a second end coupled to the first inner engagement wall. The tamper band includes a second outer wall portion extending downwardly from the central wall and a second inner engagement wall extending radially inward and upward away from the second outer wall portion. The second inner engagement wall includes an outer surface facing an inner surface of the second outer wall portion and an inner surface facing radially inward toward the central wall. The tamper band includes a second connector having a first end coupled to the second outer wall portion and a second end coupled to the second inner engagement wall. The tamper band includes a first frangible bridge section located between a clockwise facing surface of the second outer wall portion and a counterclockwise facing surface of the first outer wall portion. The tamper band includes a second frangible bridge section located between a counterclockwise facing surface of the second outer wall portion and a clockwise facing surface of the first outer wall portion.

Various embodiments of the invention relate to any of the features, structures, elements, parameters, method steps, systems, components, subsystems, etc. described and shown herein, and various embodiments of the invention relate to any combination the features, structures, elements, parameters, method steps, systems, components, subsystems, etc. described and shown herein.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the figures, in various embodiments, a container closure assembly that includes a closure that is molded and a separately molded spout having a plastic neck finish are provided. In general the closure is attached to the spout via an engagement structure, such as threading. The closure includes an integral and folded tamper band that, upon removal interacts with a flange on the spout to both break the tamper band and to push the broken tamper band outward enhancing the visibility/detectability of the broken tamper band. In addition, the spout includes a structure located at the lower, input end of the spout that acts to limit or prevent flexible sidewalls of a pouch type container from occluding the input end of the spout, that may otherwise occur as the contents of the pouch are being consumed through the spout.

Figure 1:
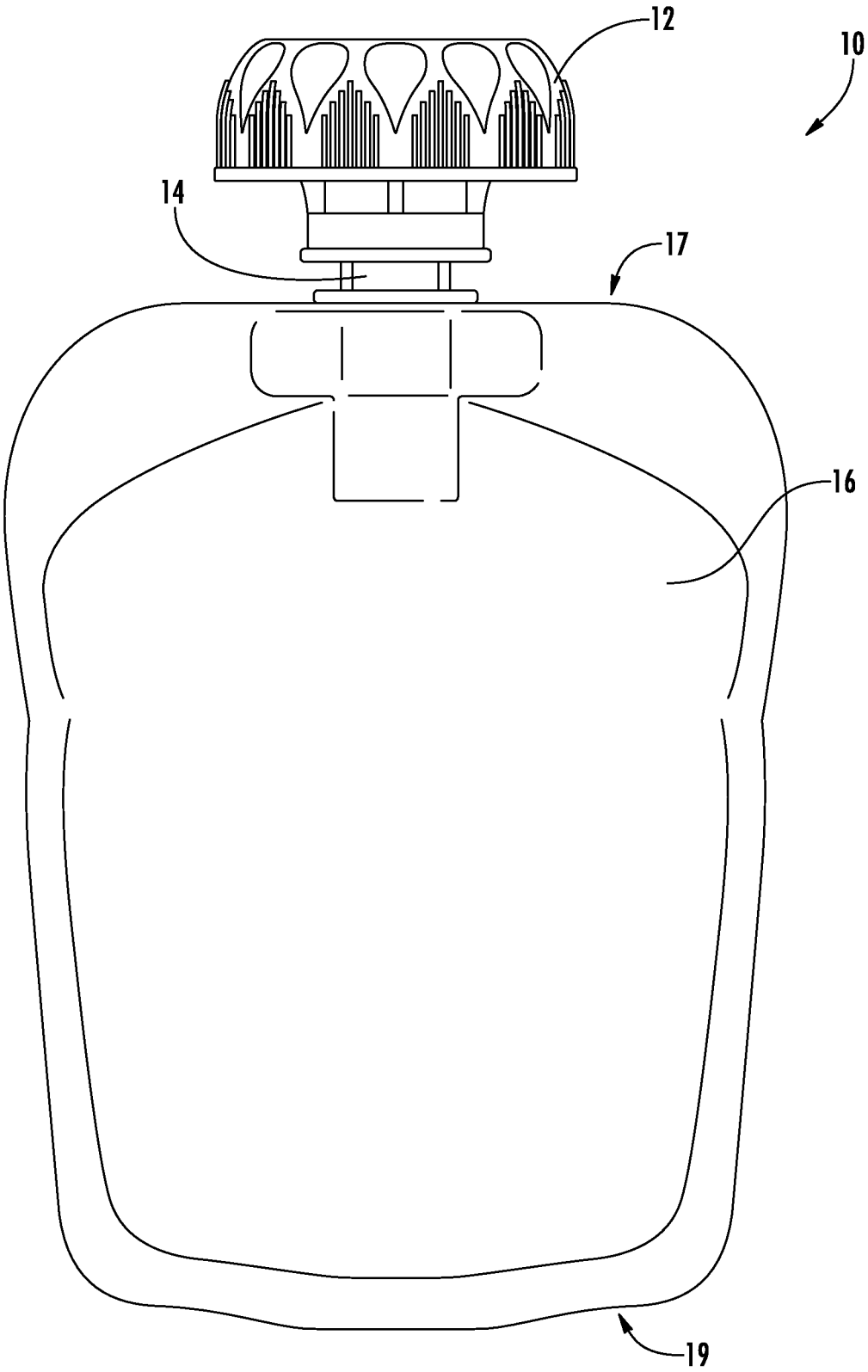
FIG. 1 shows a container closure assembly coupled to a pouch-type container according to an exemplary embodiment.

FIG. 1 shows a container assembly 10 according to an exemplary embodiment. Container assembly 10 includes a closure assembly, including a closure 12 and a spout 14. Spout 14 is coupled to a container, shown as pouch 16. In general, pouch 16 includes container contents, such as liquid, semi-liquid, or powdered food or beverage, within pouch 16, and spout 14 provides a channel through which the contents of pouch 16 can be accessed. In the embodiment shown, pouch 16 is a flexible, squeezable type of container, which may be formed from a flexible material. In various embodiments, the flexible material may be a material such as a thermoplastic sheet or a foil pouch. In other embodiments, closure 12 and spout 14 may be used in conjunction with other types of containers, such as plastic bottles or composite (paper, cardboard, etc.) boxes. In specific embodiments, the contents of pouch 16 may be food or beverage intend for consumption by a child, such as baby food, yogurt, apple sauce, etc.

FIG. 1 shows spout 14 coupled to pouch 16 adjacent to the upper end 17 of pouch 16. In this arrangement, spout 14 protrudes from the upper end of pouch 16, and closure 12 acts to seal spout 14. As will be generally understood, the lower end 19 of pouch 16 may provide an end wall or rim providing a stable base for pouch 16 to sit in the upright position shown in FIG. 1.

Figure 2:
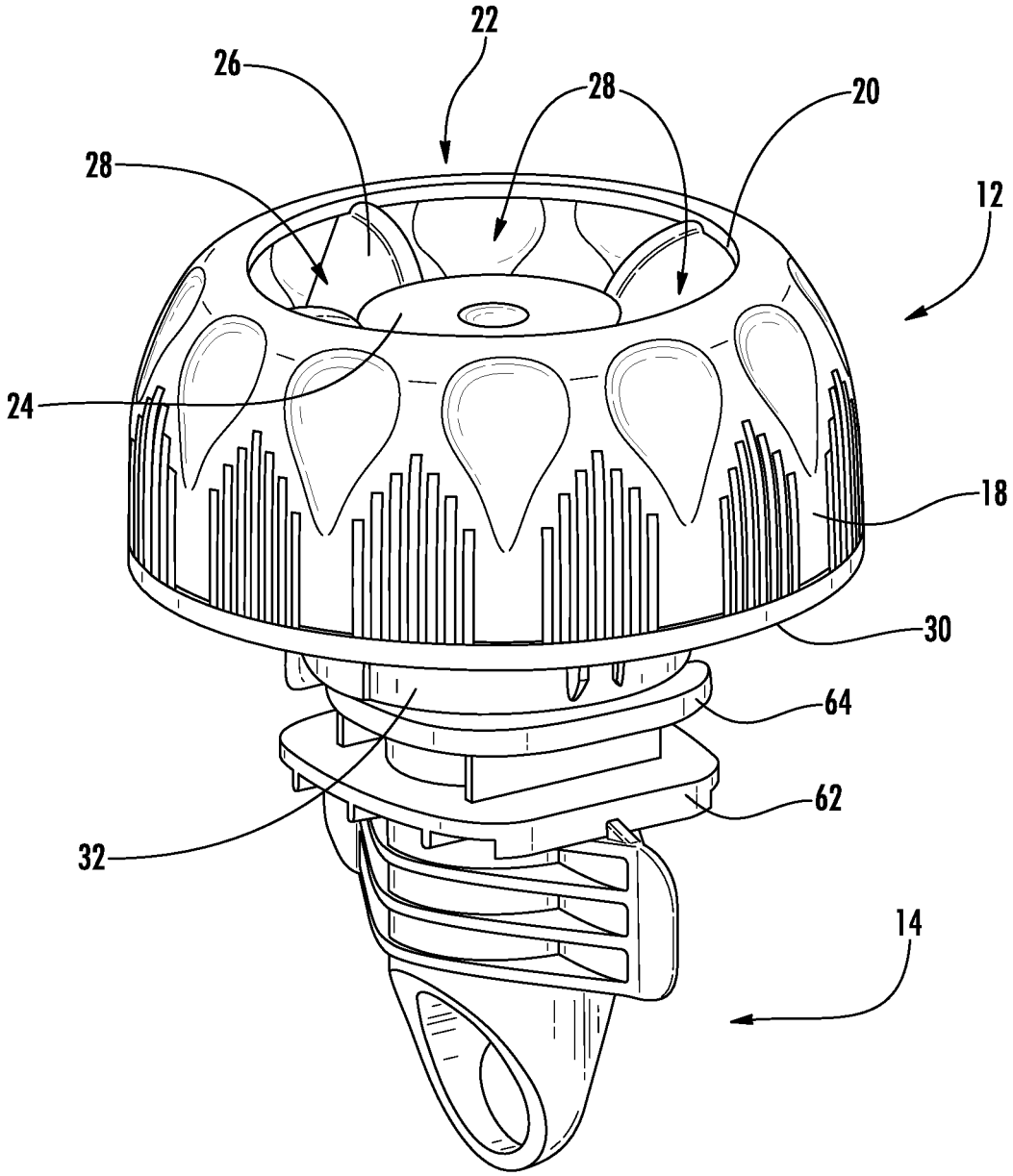
FIG. 2 is a perspective view of container closure assembly including a closure and a spout according to an exemplary embodiment.

FIG. 2 shows closure 12 coupled to an upper spout portion of spout 14. In various embodiments, closure 12 includes threads that engage cooperating threads on an outer surface of the upper spout portion. Closure 12 includes an outer wall 18, with an interior upper edge 20 that defines a top opening 22. Closure 12 includes a central wall portion, shown as central cylinder 24, that is coupled to an inner surface of outer wall 18 by radial walls 26 such that open spaces or channels 28 are defined within closure 12. Channels 28 extend vertically through closure 12 from interior upper edge 20 to lower edge 30 such that airflow is permitted through closure 12.

Figure 3:
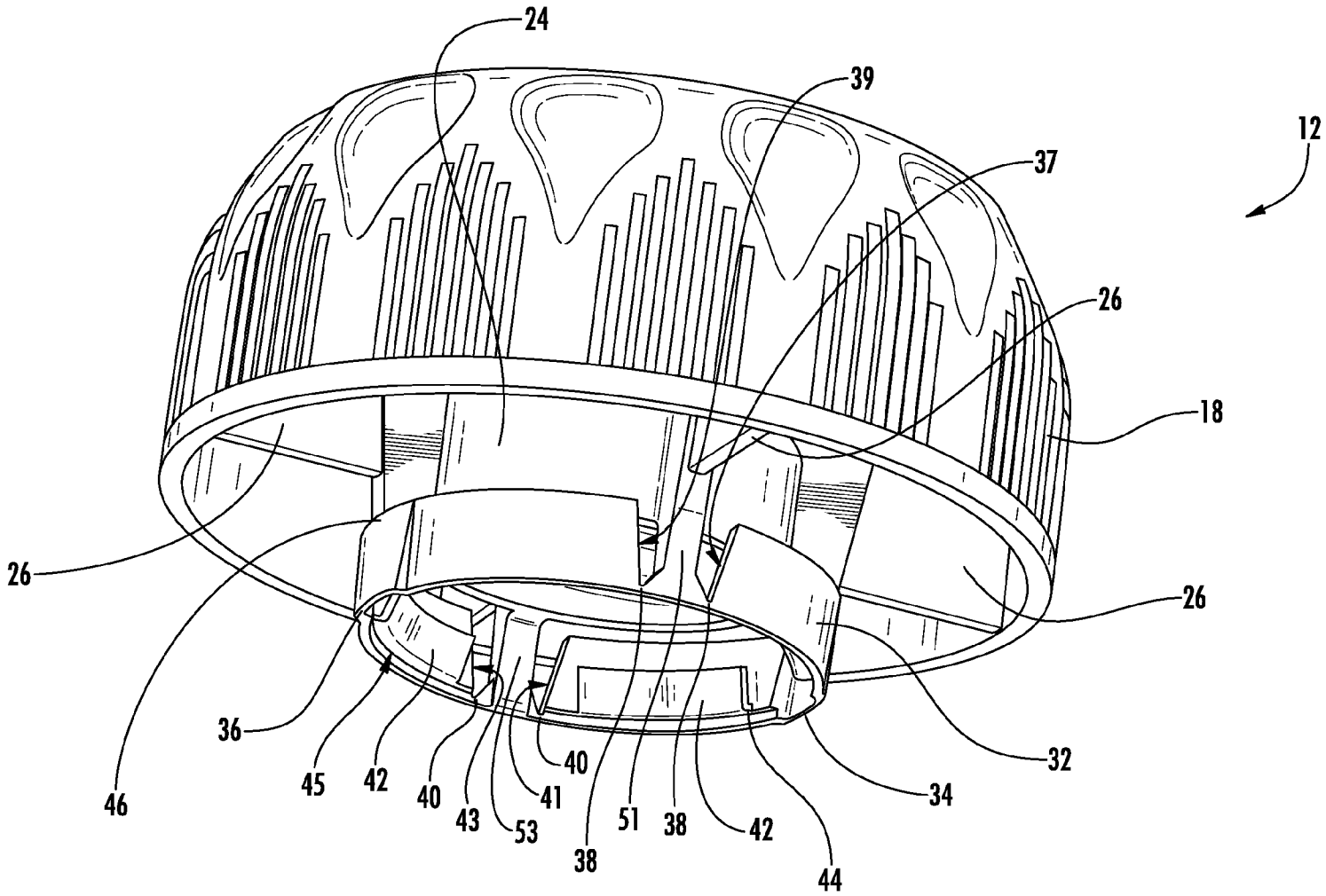
FIG. 3 is perspective view from below of the closure of FIG. 2 according to an exemplary embodiment.
Figure 4:
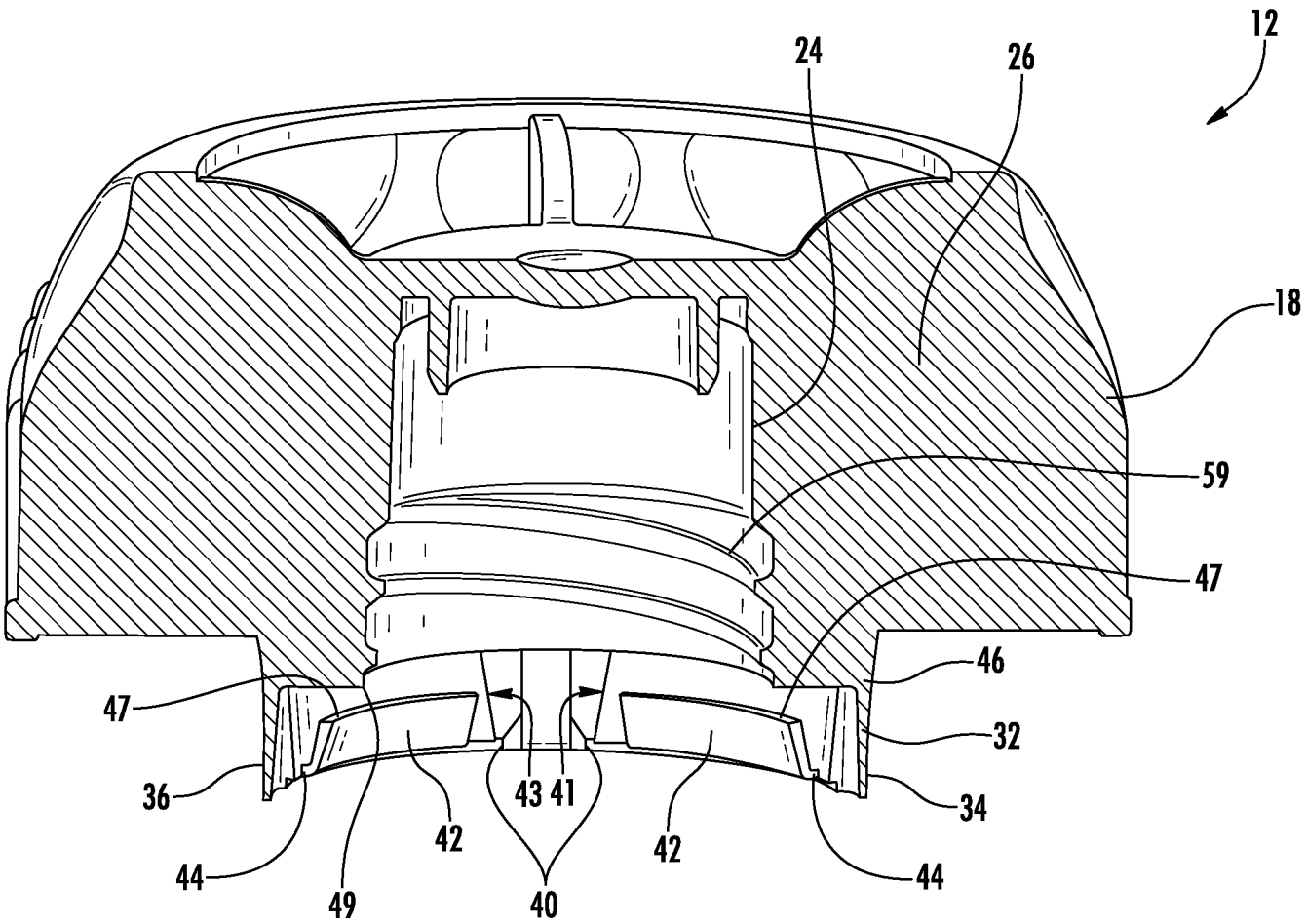
FIG. 4 is a perspective view of a section of the closure of FIG. 3 according to an exemplary embodiment.

Referring to FIG. 3 and FIG. 4, closure 12 includes a tamper band 32 extending from the lower end of central cylinder 24. Tamper band 32 includes two outer wall sections 34 and 36. A first pair of bridge sections 38 is located between first ends 37 and 39 of tamper band outer wall sections 34 and 36, respectively. A second pair of bridge sections 40 are located between second ends 41 and 43 of tamper band outer wall sections 34 and 36, respectively. Each section 34 and 36 of tamper band 32 includes two engagement structures or walls, shown as J-band sections 42, that extend radially inward away from inner surfaces of outer wall sections 34 and 36 and upward toward the upper end of closure 12.

In various embodiments, outer wall sections 34 and 36 are configured to provide a relatively compete band surrounding the base of central cylinder 24. In various embodiments, outer wall sections 34 and 36 each extend at least 120 degrees around the perimeter of central cylinder 24, specifically at least 150 degrees around the perimeter of central cylinder 24, and more specifically at least 160 degrees around the perimeter of central cylinder 24.

In the embodiment shown, J-band sections 42 are sections that are integrally molded with the rest of tamper band 32 and are connected to the lower end 45 of tamper band 32. In one embodiment, J-band sections 42 are molded in the positioning shown in FIG. 3 with a connector, shown as u-shaped curved connector section 44, molded in the u-shape shown in FIG. 3. In another embodiment, J-band sections 42 are molded extending downward from lower end 45, and following molding, J-band sections 42 are folded upward and inward relative to tamper band 32 forming u-shaped connector section 44. In either molding arrangement, connector section 44 provides the transition from the generally downwardly extending outer wall section 34 or 36 to the generally upwardly extending J-band sections 42.

As shown best in FIG. 4, J-band sections 42 are angled relative to outer wall sections 34 and 36. Further, J-band sections 42 each have an upper edge or surface 47 that defines the upper most surface of each J-band section 42. J-band sections 42 have a height (e.g., the dimension in the direction of the longitudinal axis of the closure) that is less than the heights of outer wall sections 34 and 36. In this arrangement, upper surface 47 is below both the uppermost portions of outer wall sections 34 and 36, and below the lower most edge 49 of central cylinder 24. Further, as shown in both FIG. 3 and FIG. 4, both outer wall sections 34 and 36 have a length in the circumferential direction that is greater than the length of J-band sections 42 in the circumferential direction. In various embodiments, the linear length of outer wall sections 34 and 36 in the circumferential direction is greater than the linear length of J-band sections 42 in the circumferential direction. In various embodiments, the angular length of outer wall sections 34 and 36 in the circumferential direction is greater than the angular length of J-band sections 42 in the circumferential direction. In specific embodiments, the differential circumferential lengths of outer wall sections 34 and 36 and of J-band sections 42 are the differential lengths between the major, radially inner surfaces of outer wall sections 34 and 36 and the major, radially outer surfaces of J-band sections 42.

FIG. 4 shows approximately one half of closure 12 in cross-section. Accordingly, as shown in FIG. 4, each half section of each of the tamper band outer wall sections 34 and 36 includes one J-band section 42. Thus, in the embodiment of closure 12 shown, tamper band 32 includes a total of four J-band sections 42. However, in other embodiments, tamper band 32 may include various numbers of J-band sections 42, such as 2, 3, 5, 6, etc. J-band sections.

Upon twist-off of closure 12, J-band sections 42 interact with cooperating structures on spout 14 (discussed below) as closure 12 moves upward which causes bridge sections 38 and 40 to break and which also pushes tamper band sections 34 and 36 outward. Tamper band sections 34 and 36 remain connected to the central cylinder 24 by an integrally molded hinge structure 46 (labeled in FIG. 4) that joins each tamper band section 34, 36 to at least one of central cylinder 24 and radial walls 26. In this manner, tamper band 32 remains coupled to and intact with closure 12 even after opening of closure 12.

As shown best in FIG. 3, tamper band 32 includes two tamper band posts, shown as post sections 51 and 53. Post section 51 is located in the circumferential direction between first ends 37 and 39 of tamper band outer wall sections 34 and 36, and post section 53 is located in the circumferential direction between second ends 41 and 43 of tamper band outer wall sections 34 and 36. In general, post sections 51 and 53 provide a structure that bridges 38 and 40 respectively are coupled to.

In this arrangement, the clockwise and counterclockwise facing surfaces of post sections 51 and 53 and the opposing, clockwise and counterclockwise facing surfaces of the adjacent outer wall sections 34 and 36 define spaces or gaps as shown in FIG. 3. To further provide structure to tamper band 32, each of post sections 51 and 53 are located below one of the radial walls 26. By providing a relatively robust, rigid and supported anchor point, this positioning of post sections 51 and 53 may facilitate consistent breakage of tamper band 32 at bridges 38 and 40 upon removal of closure 12 because of the relative low level of bend or distortion experienced by post sections 51 and 53 at twist off. In this arrangement, bridge sections 38 and 40 are coupled between opposing clockwise and counterclockwise surfaces of post sections 51 and 53 and of outer wall sections 34 and 36.

Figure 5:
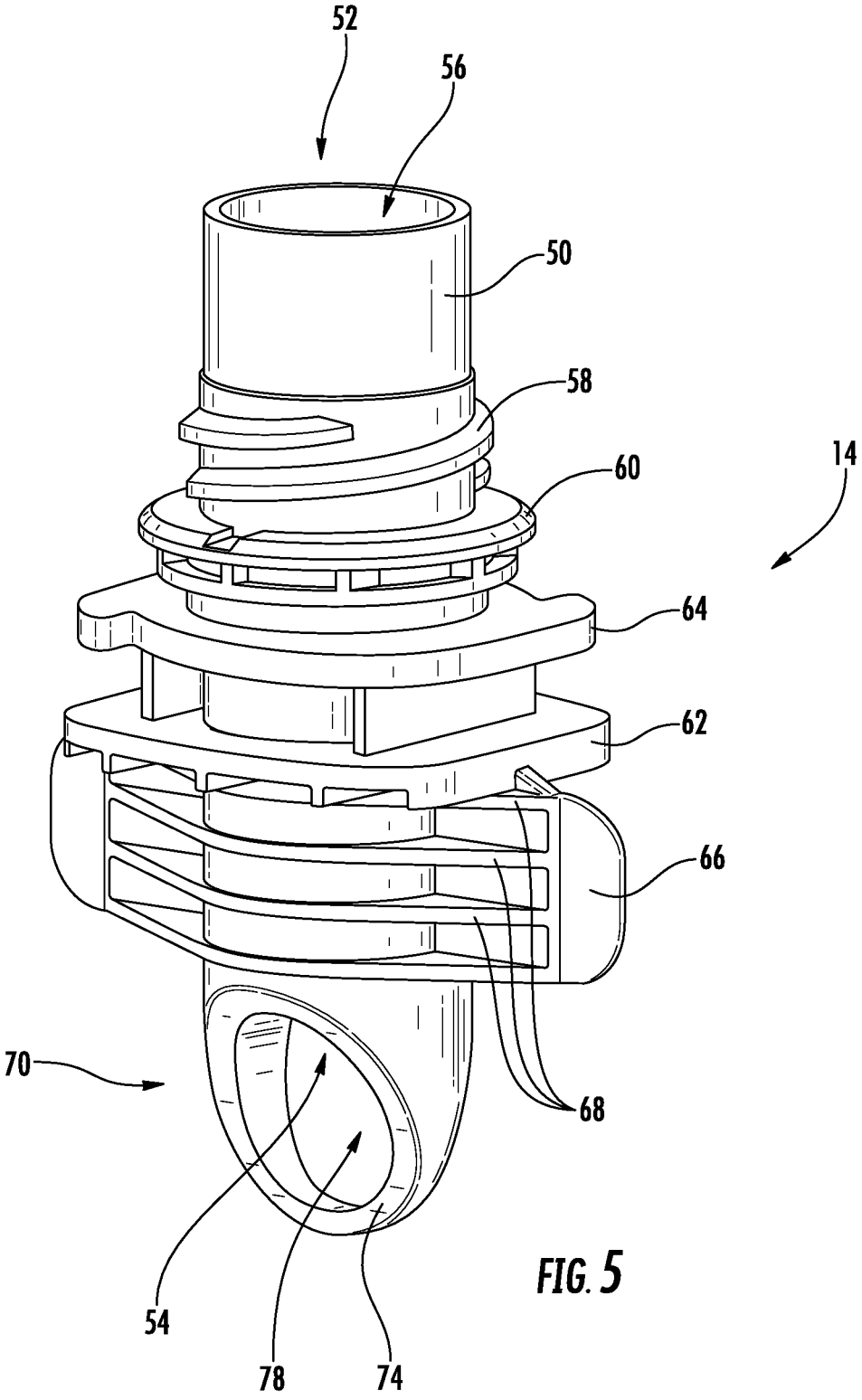
FIG. 5 is a perspective view from above of the spout of FIG. 2 according to an exemplary embodiment.

Referring to FIG. 5, a perspective view of spout 14 is shown according to an exemplary embodiment. Spout 14 includes an upper spout portion 50 that defines a central channel 52 that extends through spout 14 from an input or inlet opening 54 and an output or outlet opening 56. In general, central channel 52 provides a pathway from the interior of a container (such as pouch 16) to the exterior of the container through which container contents can be accessed and removed. Upper spout portion 50 includes a closure engagement structure, shown as threads 58, that engage cooperating threads 59 (shown in FIG. 4) on the inner surface of central cylinder 24 of closure 12.

Spout 14 includes an upper flange 60 located below threads 58. Spout 14 includes a lower flange 62 and a central flange 64. Located below lower flange 62 is a generally trapezoidal shaped mounting area 66 that includes a plurality of horizontal ribs 68. Mounting area 66 and ribs 68 are bonded to the inner surface of the container sidewalls (e.g., sidewalls of pouch 16) such that spout 14 is supported from the container as shown in FIG. 1.

Figure 6:
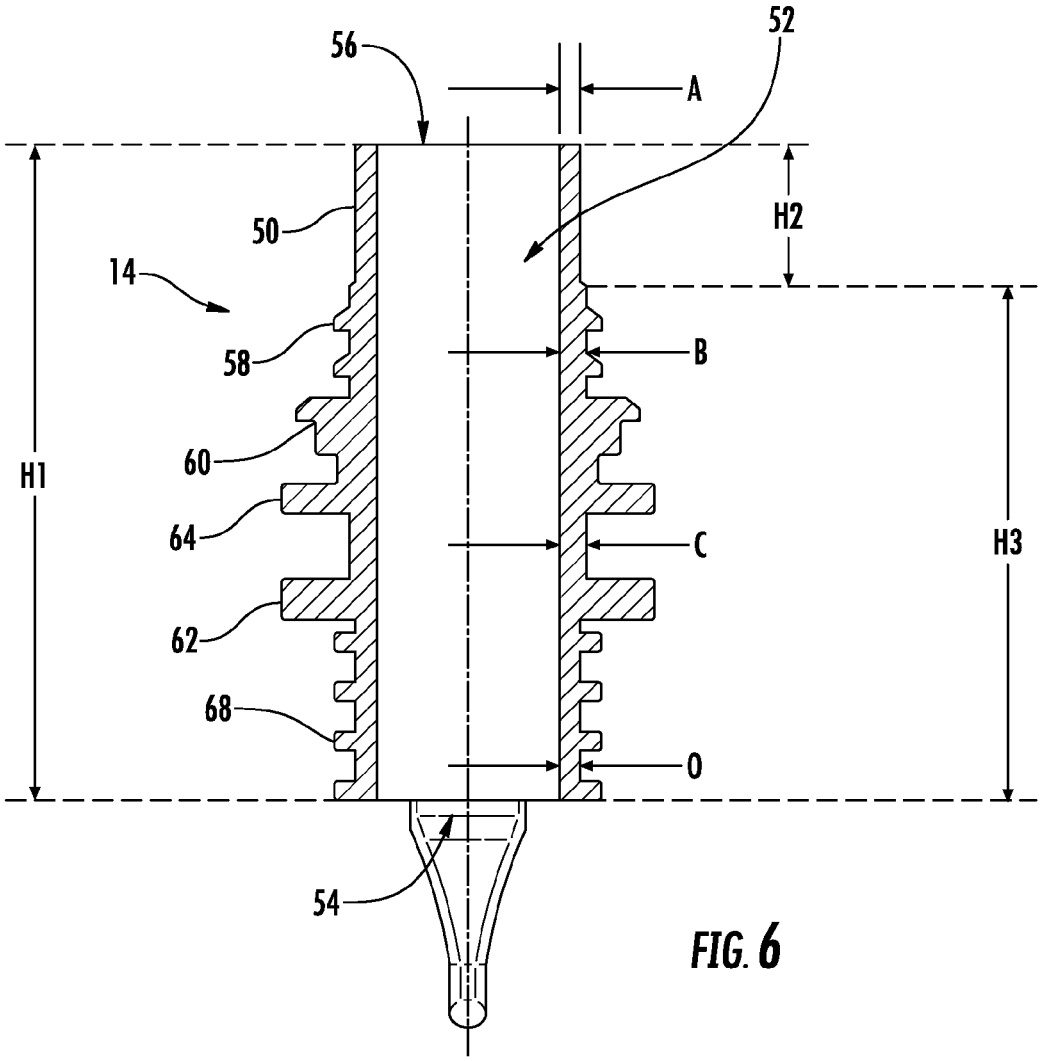
FIG. 6 is a cross-sectional view of the spout of FIG. 2 according to an exemplary embodiment.

Referring to FIG. 6, in various embodiments, spout 14 is molded from plastic and has thicknesses along the length of spout 14 that facilitates accurate molding of spout 14. As shown in FIG. 6, upper spout portion 50 has a thickness A and a height H2. In various embodiments, upper spout portion 50 has a thickness A between 0.025 inches and 0.040 inches, specifically between 0.028 inches and 0.032 inches, and more specifically about 0.030 inches (e.g., plus or minus 0.005 inches). In various embodiments, spout 14 has a total height H1, and H2 is less than 30% of H1 and more specifically is less than 25% of H1. In addition, spout 14 has a thickness B located between threads 58, and in various embodiments, thickness B is between 0.035 inches and 0.045 inches, specifically between 0.038 inches and 0.042 inches, and more specifically about 0.040 inches (e.g., plus or minus 0.005 inches). Spout 14 has a thickness C located between flanges 62 and 64, and in various embodiments, thickness C is between 0.038 inches and 0.048 inches, specifically between 0.041 inches and 0.045 inches, and more specifically about 0.043 inches (e.g., plus or minus 0.005 inches). Spout 14 has a thickness D located between ribs 68, and in various embodiments, thickness D is between 0.038 inches and 0.048 inches, specifically between 0.041 inches and 0.045 inches, and more specifically about 0.043 inches (e.g., plus or minus 0.005 inches). In various embodiments, the areas having thicknesses B, C and D have a height shown as H3, and in various embodiments, H3 is greater than 60% of H1, and more specifically greater than 70% of H1.

Figure 7:
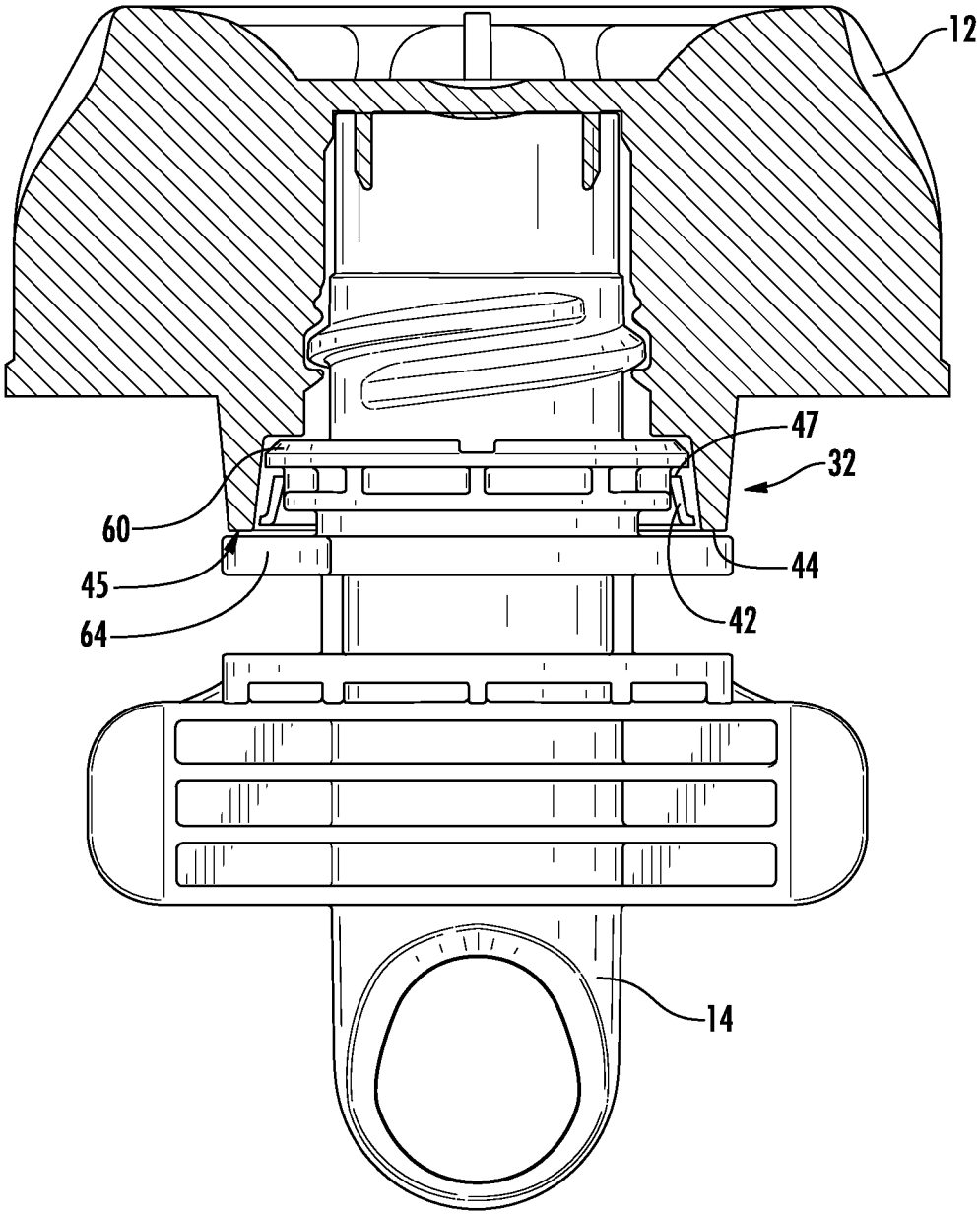
FIG. 7 is a cross-sectional view of the closure of FIG. 2 coupled to the spout of FIG. 2 according to an exemplary embodiment.

Referring to FIG. 7, closure 12 is shown coupled to spout 14. As shown in FIG. 7, when closure 12 is fully engaged on spout 14, J-band sections 42 are engaged underneath flange 60. In this arrangement, lower end 45 of tamper band 32 is facing flange 64 and there is a small amount of clearance between the lower most surface of tamper band 32 and the upper surface of flange 64. Further, J-band sections 42 are positioned such that upper surfaces 47 of each J-band are facing and located beneath flange 60.

Figure 8:
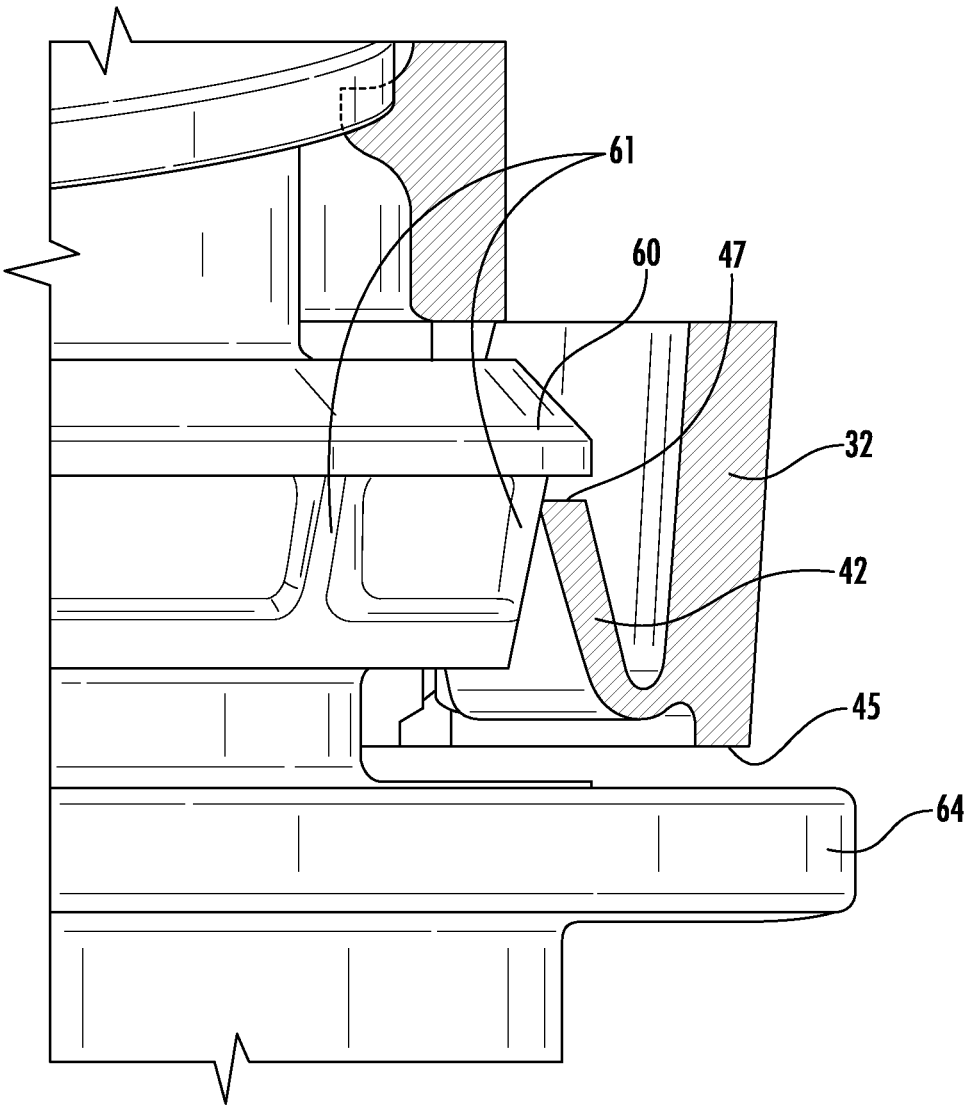
FIG. 8 is a detailed view showing interaction between a spout and a tamper band according to an exemplary embodiment.

Referring to FIG. 8, a detailed view of the interaction between J-bands 42 and spout 14 are shown. Spout 14 includes a plurality of generally vertically extending ribs 61 located below flange 60. Ribs 61 interact with the radially innermost section of J-band 42 during cap removal limiting the ability of J-bands 42 from tucking under flange 60. In this manner, ribs 61 provide a surface that allows J-bands 42 to transition over the outermost edge of flange 60 during cap removal.

Figure 9:
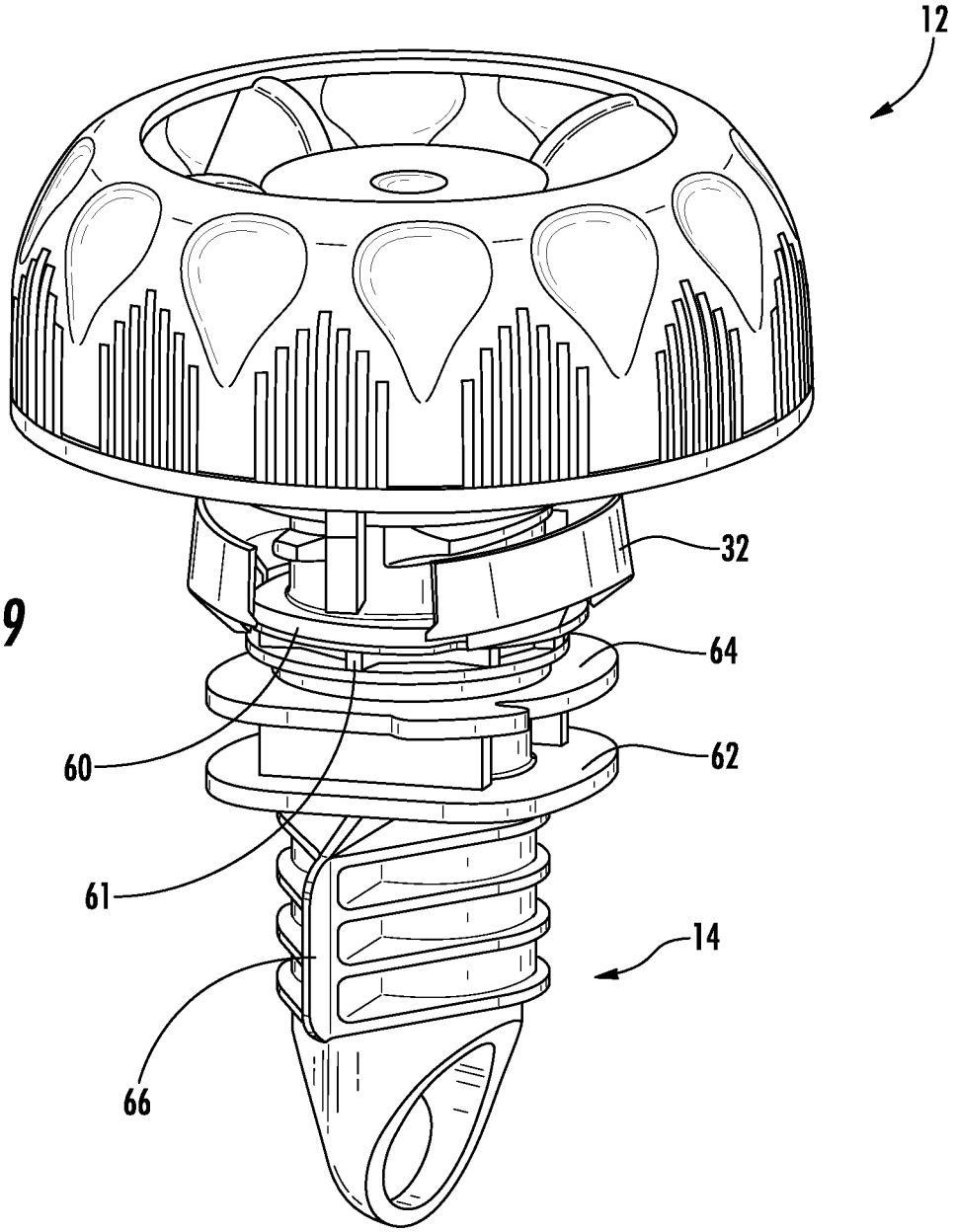
FIG. 9 is a perspective view of container closure assembly of FIG. 2 showing a broken tamper band according to an exemplary embodiment.

Referring to FIG. 9, closure 12 is shown during removal from spout 14 according to an exemplary embodiment. Flange 60 includes an outer surface that acts as a catch ledge. As closure 12 is removed, J-band sections 42 interact with flange 60 to push tamper band 32 outward and to break bridges 38 and 40. Specifically, as tamper band 32 passes over flange 60 upon removal of closure 12, flange 60 acts to spread broken tamper band 32 and pushes broken tamper band 32 radially outward. The broken sections of tamper band 32 pivot radially outward about hinges 46 under the interaction with flange 60 further accentuating the appearance of the broken tamper bands. The broken bridge sections 38 and 40 and the outwardly pushed tamper band 32 provides tamper indication by showing that closure 12 has previously been opened, as shown in FIG. 9.

Figure 10:
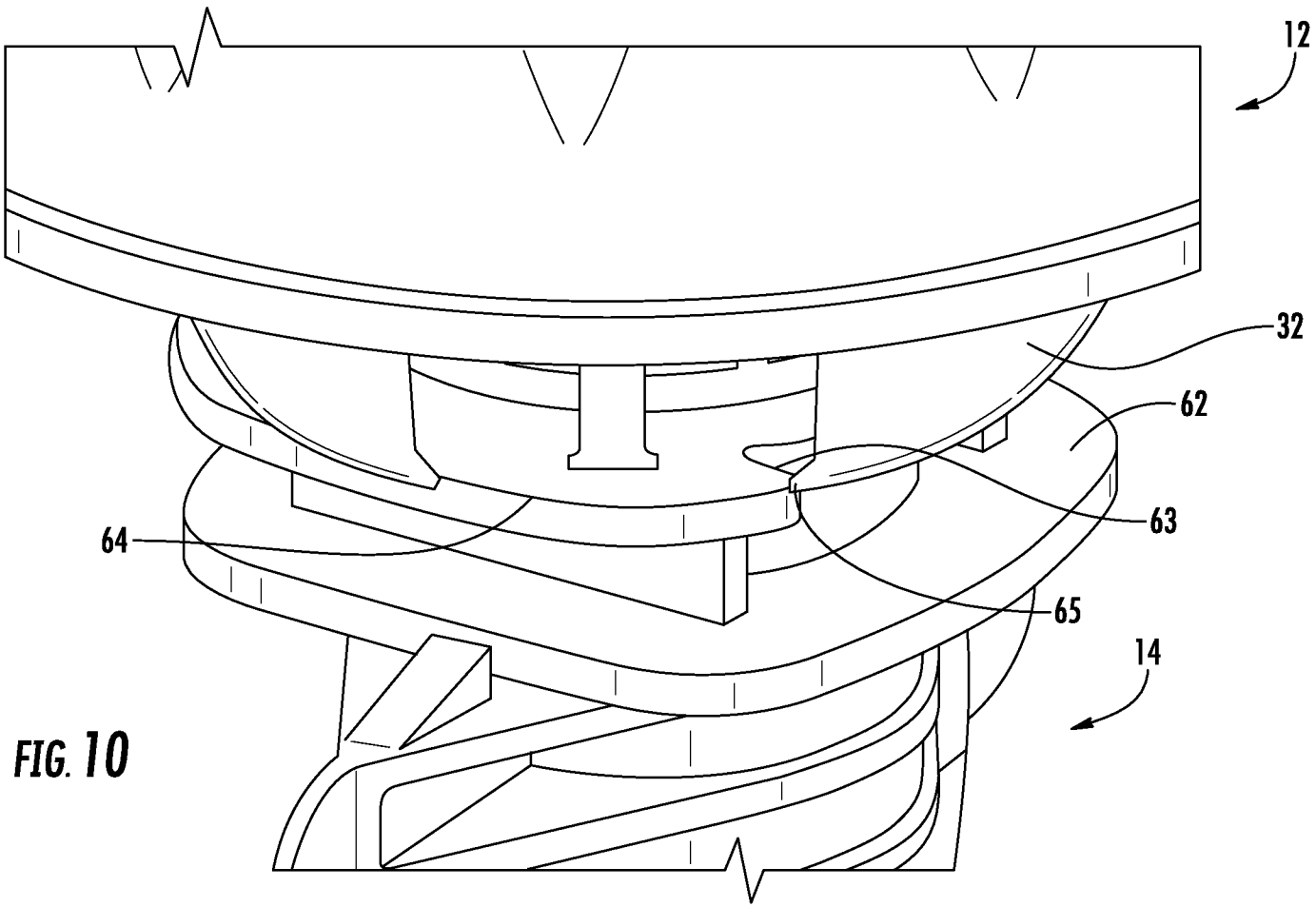
FIG. 10 is a detailed view showing interaction between a spout and a broken tamper band according to another exemplary embodiment.

Referring to FIG. 10, a detailed view of the interaction between broken tamper band 32 and spout 14 is shown according to an exemplary embodiment. As shown in FIG. 10, flange 64 of spout 14 includes a plurality of circumferentially facing surfaces, shown as counterclockwise surfaces 63. In the embodiment shown, flange 64 includes two counterclockwise surfaces 63 spaced about 180 degrees apart around the circumference of flange 64. After closure 12 has been first removed from spout 14, tamper band 32 is broken at bridges 38 and 40 forming free ends 65. Upon reapplication of closure 12 following opening, free ends 65 of broken tamper band 32 to engage counterclockwise surfaces 63 which acts to maintain tamper band 32 in a position such that it is easy to see that tamper band 32 had previously been broken.

Figure 11:
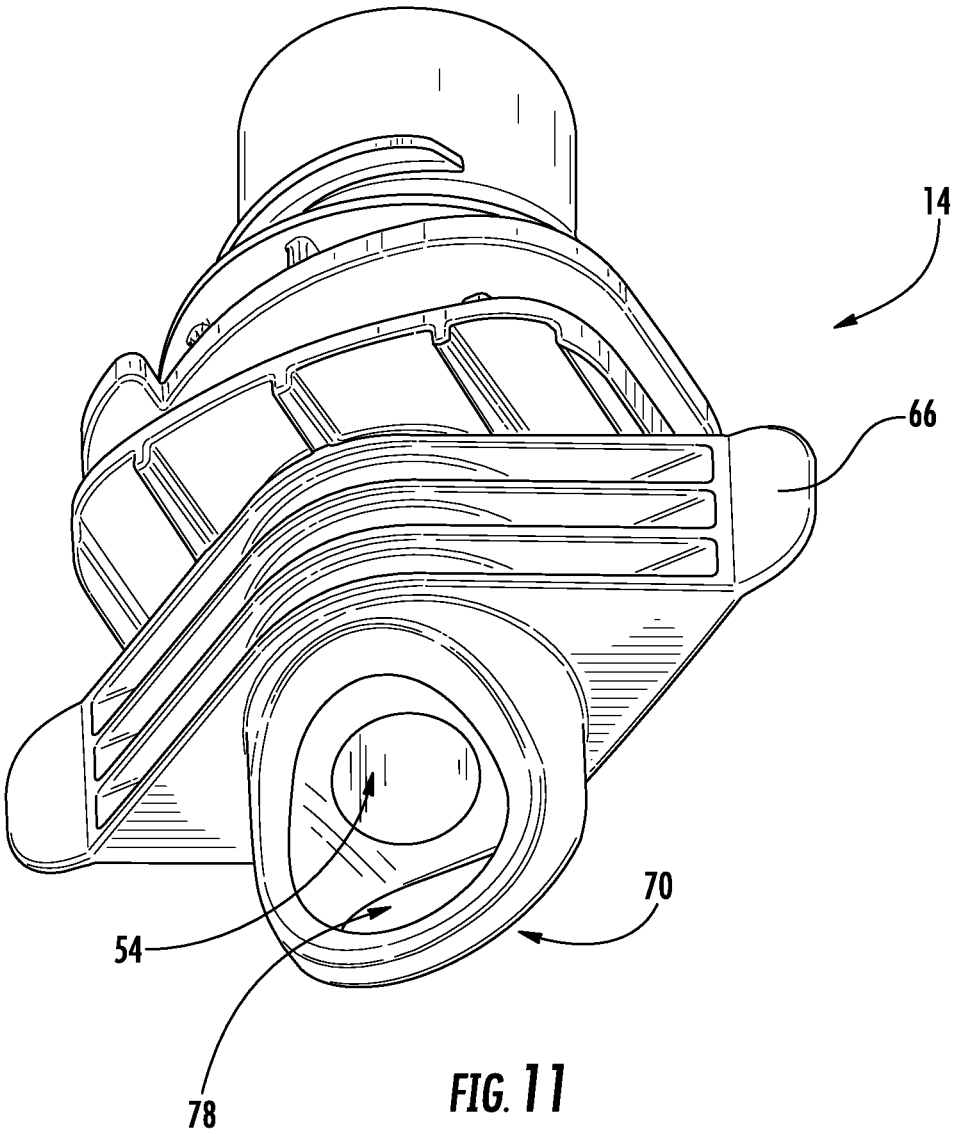
FIG. 11 is a perspective view from below of the spout of FIG. 2 according to an exemplary embodiment.
Figure 12:
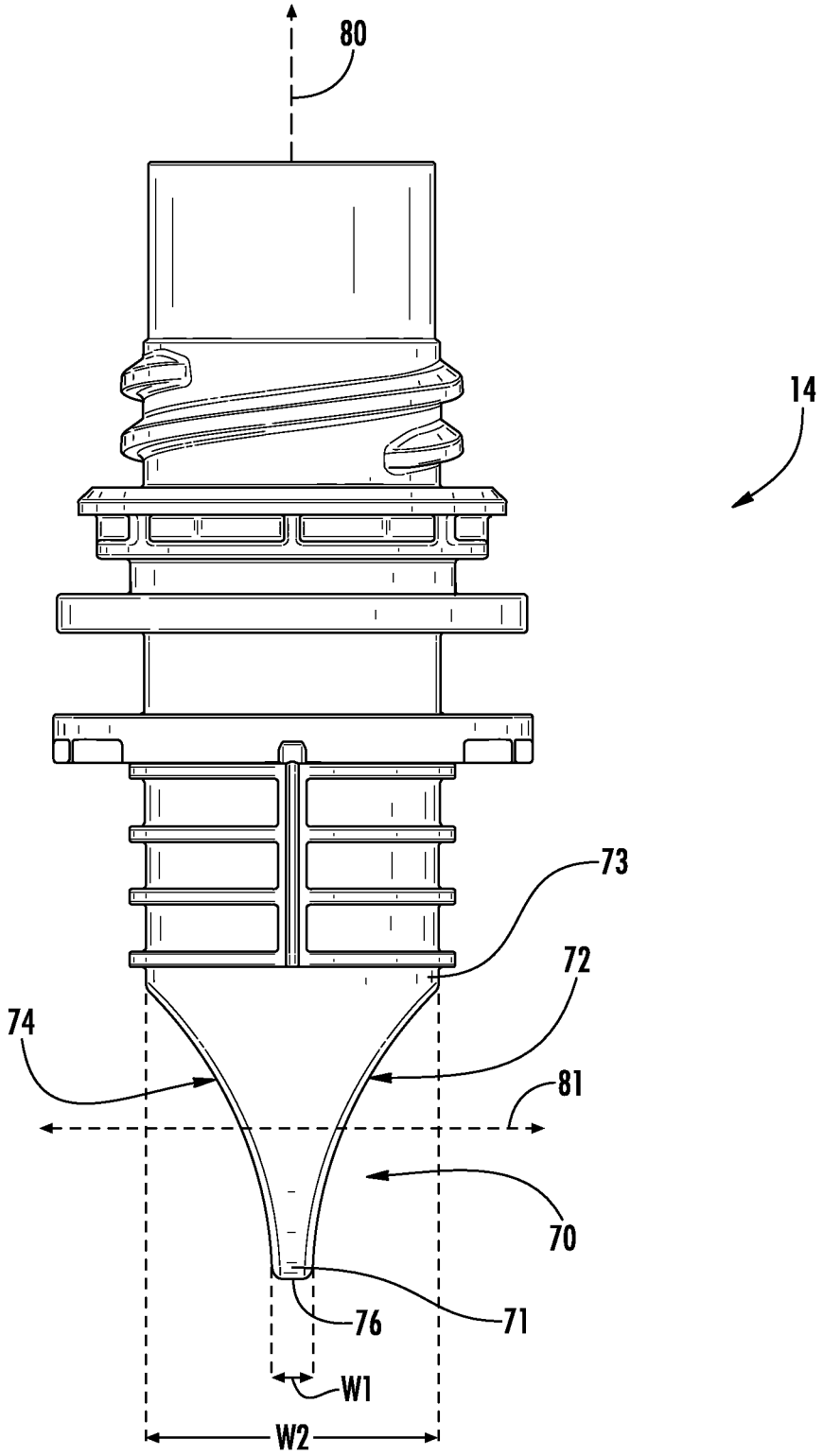
FIG. 12 is a side view of the spout of FIG. 2 according to an exemplary embodiment.

Referring to FIG. 11 and FIG. 12, spout 14 includes a structure surrounding lower opening 54 that acts to limit occlusion of spout opening 54. In the specific embodiment shown, spout 14 includes a structure 70 extending from a lower surface of mounting area 66 that surrounds lower opening 54 of spout 14 and acts to limit or prevent opening 54 from being occluded by the sidewall of the container (e.g., pouch 16) to which spout 14 is attached. In general, structure 70 defines a lower channel, shown as ring shaped channel 78, and at least a portion of the entrances to channel 78 lie in a plane substantially parallel to the wings of mounting structure 66.

Referring to FIG. 12, structure 70 includes opposing surfaces 72 and 74 that taper inward toward central axis 80 and that extend downward to bottom surface 76. Channel 78 defines an axis 81 that is substantially perpendicular to both axis 80 and to a plane defined by mounting structure 66. In this arrangement, channel 78 extends between opposing surfaces 72 and 74, and opposing surfaces 72 and 74 are angled inward relative to a plane defined by mounting structure 66. Further, in various embodiments, surfaces 72 and 74 are angled inward toward axis 80.

In various embodiments as shown in FIG. 12, the width, W1, of the tip 71 of structure 70 is relatively small compared to the width, W2, of the upper end 73 of structure 70. In various embodiments, W1 is less than 50% of W2, specifically is less than 30% of W2, and more specifically is less than 20% of W2. In this arrangement, surfaces 72 and 74 generally face the inner surfaces of container 16 and provides an elongate ring structure that limits the ability of inner surfaces of container 16 to occlude or block lower spout opening 54.

To further facilitate the occlusion limiting function of structure 70, surfaces 72 and 74 are curved surfaces that are concave relative to axis 80. In various embodiments, surfaces 72 and 74 are continuously curved surfaces that curve inward toward axis 80. Curved surfaces 72 and 74 may act to provide improved occlusion resistance relative to planar angled walls due to the changing degree of distance between the curved surface 72 and 74 and the inner wall of a container (such as pouch 16).

Figure 13:
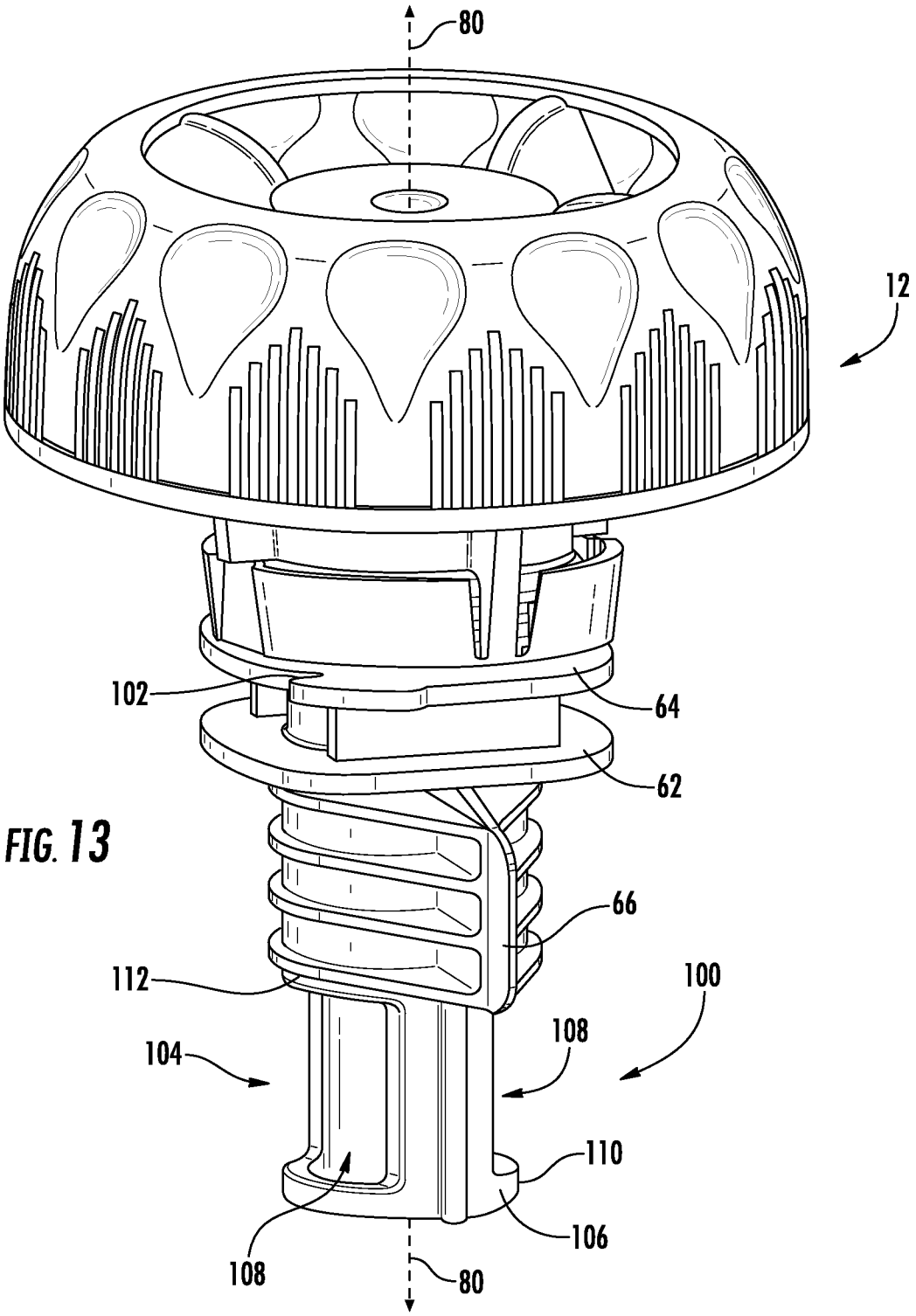
FIG. 13 is a perspective view of container closure assembly including a closure and a spout according to another exemplary embodiment.

Referring to FIG. 13, closure 12 is shown coupled to a spout 100 according to an exemplary embodiment. Spout 100 is substantially the same as spout 14 except as discussed herein. Spout 100 includes clockwise facing radial surfaces 102 on flange 64. Further, spout 100 includes a structure 104 that surrounds lower spout opening 54 that acts to limit occlusion of spout opening 54. In general, structure 104 includes a lower end flange 106, and at least two generally rectangular, substantially vertical openings 108. Openings 108 are recessed in the direction of axis 80 relative to radial outermost surface 110 of flange 106 and radial surface 112 located below mounting structure 66. In this manner, surfaces 110 and 112 act to space the walls of the container (e.g., pouch 16) from opening 108 such that the walls do not occlude opening 108.

In various embodiments, the closure and spout discussed herein are made from plastic. In various embodiments, the closure and spout are made from compression molded plastic, and in other embodiments, the closure and spout are made from injection molded plastic. In various embodiments, the plastics include PE, PP, PET, PVC, etc.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. It should also be understood that the terminology is for the purpose of description only and should not be regarded as limiting.

What is claimed is:

1. A tamper evident closure, comprising:

an outer wall having an inner surface and an outer surface;

a central wall supported from the outer wall, the central wall having an inner surface, an outer surface and an engagement structure located on the inner surface and configured to engage cooperating structures on a spout;

a passage extending between an upper edge and a lower edge of the closure, the passage defined between the inner surface of the outer wall and the outer surface of the central wall; and a tamper-indicating band extending from the central wall, the tamper band comprising:

a first outer wall portion extending downwardly from the central wall;

a first inner engagement wall extending radially inward and upward away from the first outer wall portion, wherein the first inner engagement wall includes an outer surface facing an inner surface of the first outer wall portion and an inner surface facing radially inward toward the central wall; and a first connector having a first end coupled to the first outer wall portion and a second end coupled to the first inner engagement wall.

2. The closure of claim 1 wherein the first connector includes a curved section providing the transition from the downwardly extending first outer wall portion to the upwardly extending first inner engagement wall.

3. The closure of claim 1 wherein the first inner engagement wall has an upper surface, wherein the upper surface of the first inner engagement wall is located below an upper edge of the first outer wall portion.

4. The closure of claim 1 wherein the first inner engagement wall has an upper surface, wherein the upper surface of the first inner engagement wall is located below a lower surface of the central wall.

5. The closure of claim 1 wherein the inner surface of the first outer wall portion has a length in a circumferential direction that is greater than a length of the outer surface of the first engagement wall in the circumferential direction.

6. The closure of claim 1 wherein the tamper band further comprises:

a second outer wall portion extending downwardly from the central wall;

a second inner engagement wall extending radially inward and upward away from the second outer wall portion, wherein the second inner engagement wall includes an outer surface facing an inner surface of the second outer wall portion and an inner surface facing radially inward toward the central wall;

a second connector having a first end coupled to the second outer wall portion and a second end coupled to the second inner engagement wall;

a first frangible bridge section located between a clockwise facing surface of the second outer wall portion and a counterclockwise facing surface of the first outer wall portion; and a second frangible bridge section located between a counterclockwise facing surface of the second outer wall portion and a clockwise facing surface of the first outer wall portion.

7. The closure of claim 6 further comprising:

a first hinge structure coupling the first outer wall portion to the central wall, wherein the first hinge structure allows the first outer wall portion to pivot relative to the central wall following breakage of the first and second frangible bridges; and a second hinge structure coupling the second outer wall portion to the central wall, wherein the second hinge structure allows the second outer wall portion to pivot relative to the central wall following breakage of the first and second frangible bridges.

8. The closure of claim 7 wherein the inner surface of the central wall is circular in cross-section, wherein the first outer wall portion extends at least 120 degrees around the central wall and the second outer wall portion extends at least 120 degrees around the central wall.

9. The closure of claim 8 further comprising:

a first tamper band post extending downward from the central wall and located between the clockwise facing surface of the second outer wall portion and the counterclockwise facing surface of the first outer wall portion, wherein the first tamper band post includes a clockwise facing surface facing the counterclockwise facing surface of the first outer wall portion defining a first gap therebetween and a counterclockwise facing surface facing the clockwise facing surface of the second outer wall portion defining a second gap therebetween;

a second tamper band post extending downward from the central wall and located between the counterclockwise facing surface of the second outer wall portion and the clockwise facing surface of the first outer wall portion, wherein the second tamper band post includes a clockwise facing surface facing the counterclockwise facing surface of the second outer wall portion defining a third gap therebetween and a counterclockwise facing surface facing the clockwise facing surface of the first outer wall portion defining a fourth gap therebetween.

10. The closure of claim 9 further comprising:

a third frangible bridge section located between a clockwise facing surface of the second outer wall portion and a counterclockwise facing surface of the first outer wall portion; and a fourth frangible bridge section located between a counterclockwise facing surface of the second outer wall portion and a clockwise facing surface of the first outer wall portion;

wherein the first frangible bridge section is coupled at one end to the clockwise facing surface of the first tamper band post and at the other end to the counterclockwise facing surface of the first outer wall portion;

wherein the second frangible bridge section is coupled at one end to the counterclockwise facing surface of the second tamper band post and at the other end to the clockwise facing surface of the first outer wall portion;

wherein the third frangible bridge section is coupled at one end to the counterclockwise facing surface of the first tamper band post and at the other end to the clockwise facing surface of the second outer wall portion;

wherein the fourth frangible bridge section is coupled at one end to the clockwise facing surface of the second tamper band post and at the other end to the counterclockwise facing surface of the second outer wall portion.

11. The closure of claim 10 wherein an upper surface of the first frangible bridge section defines the lower edge of the first gap, wherein an upper surface of the third frangible bridge section defines the lower edge of the second gap, wherein an upper surface of the second frangible bridge section defines the lower edge of the fourth gap and further wherein an upper surface of the fourth frangible bridge sections define the lower edge of the third gap.

12. The closure of claim 1 coupled to a flexible pouch container.

13. A closure assembly comprising:

a spout comprising:

a wall portion including an engagement structure extending from an outer surface of the wall portion;

a central channel extending through the wall portion between an inlet opening and an outlet opening, wherein the channel surrounds a central axis of the spout;

a structure located below the inlet opening, the structure comprising:

a first exterior surface on a first side of the structure, the first exterior surface extending away from the inlet opening;

a second exterior surface on a second side of the structure opposite the first side, the second exterior surface extending away from the inlet opening;

a lower channel extending between the first and second exterior surfaces and located below the inlet opening;

wherein the first and second exterior surfaces are both angled toward the central axis of the spout such that a width between opposing portions of the first and second exterior surfaces at a lower end of the structure is less than a width between opposing portions of the first and second exterior surfaces at an upper end of the structure; and a closure comprising:

an outer wall having an inner surface and an outer surface;

a central wall supported from the inner surface of the outer wall, the central wall having an inner surface, an outer surface and an engagement structure located on the inner surface and configured to engage the engagement structure of the spout;

a passage extending between an upper edge and a lower edge of the closure, the passage defined between the inner surface of the outer wall and the outer surface of the central wall; and a tamper-indicating band extending from the central wall, the tamper band comprising:

a first outer wall portion extending downwardly from the central wall;

a first inner engagement wall extending radially inward and upward away from the first outer wall portion, wherein the first inner engagement wall includes an outer surface facing an inner surface of the first outer wall portion and an inner surface facing radially inward toward the central wall;

a first connector having a first end coupled to the first outer wall portion and a second end coupled to the first inner engagement wall;

a second outer wall portion extending downwardly from the central wall;

a second inner engagement wall extending radially inward and upward away from the second outer wall portion, wherein the second inner engagement wall includes an outer surface facing an inner surface of the second outer wall portion and an inner surface facing radially inward toward the central wall;

a second connector having a first end coupled to the second outer wall portion and a second end coupled to the second inner engagement wall;

a first frangible bridge section located between a clockwise facing surface of the second outer wall portion and a counterclockwise facing surface of the first outer wall portion; and a second frangible bridge section located between a counterclockwise facing surface of the second outer wall portion and a clockwise facing surface of the first outer wall portion.

14. The closure assembly of claim 13 wherein the first and second exterior surfaces of the structure are concave relative to the central axis, wherein the width between opposing portions of the first and second exterior surfaces at a lower end of the structure is less than 50% of the width between opposing portions of the first and second exterior surfaces at the upper end of the structure.

15. The closure assembly of claim 14 wherein the closure further comprises:

a first hinge structure coupling the first outer wall portion to the central wall, wherein the first hinge structure allows the first outer wall portion to pivot relative to the central wall following breakage of the first and second frangible bridges; and a second hinge structure coupling the second outer wall portion to the central wall, wherein the second hinge structure allows the second outer wall portion to pivot relative to the central wall following breakage of the first and second frangible bridges;

wherein the inner surface of the central wall is circular in cross-section, wherein the first outer wall portion extends at least 120 degrees around the central wall and the second outer wall portion extends at least 120 degrees around the central wall.

16. The closure assembly of claim 15 further comprising a flexible pouch container coupled to the spout, such that the inlet opening of the spout is located within the container and the outlet opening of the spout is located outside of the container.

17. A closure assembly comprising:

a closure comprising:

an outer wall having an inner surface and an outer surface;

a central wall supported from the outer wall, the central wall having an inner surface, an outer surface and an engagement structure located on the inner surface and configured to engage cooperating structures on a spout;

a passage extending between an upper edge and a lower edge of the closure, the passage defined between the inner surface of the outer wall and the outer surface of the central wall; and a tamper-indicating band extending from the central wall, the tamper band comprising:

a first outer wall portion extending downwardly from the central wall;

a first inner engagement wall extending radially inward and upward away from the first outer wall portion, wherein the first inner engagement wall includes an outer surface facing an inner surface of the first outer wall portion and an inner surface facing radially inward toward the central wall; and a first connector having a first end coupled to the first outer wall portion and a second end coupled to the first inner engagement wall; and a spout comprising:

a wall portion including an engagement structure configured to engage the engagement structure of the closure extending from an outer surface of the wall portion; and a central channel extending through the wall portion between an inlet opening and an outlet opening.

18. The closure assembly of claim 17, the spout further comprising a structure located below the inlet opening, the structure comprising:

a first exterior surface on a first side of the structure, the first exterior surface extending away from the inlet opening;

a second exterior surface on a second side of the structure opposite the first side, the second exterior surface extending away from the inlet opening; and a lower channel extending between the first and second exterior surfaces and located below the inlet opening.

19. The closure assembly of claim 18, wherein the first and second exterior surfaces of the spout are both angled toward the central axis of the spout such that a width between opposing portions of the first and second exterior surfaces at a lower end of the structure is less than a width between opposing portions of the first and second exterior surfaces at an upper end of the structure.

20. The closure assembly of claim 19 coupled to a container.

* * * * *